US005566998A

United States Patent [19]

Gray

[11] Patent Number: 5,566,998

[45] Date of Patent: Oct. 22, 1996

[54] CARGO CONTAINER SWIVEL-STACKING-PIN TOOL

[76] Inventor: William H. Gray, 11080 Emmanuel Church Rd., Smithfield, Va. 23430

[21] Appl. No.: 547,862

[22] Filed: Oct. 25, 1995

[51] Int. Cl.[6] ..... B25J 1/04

[52] U.S. Cl. ..... 294/24; 294/15; 294/19.1

[58] Field of Search ..... 294/1.1, 15, 17–19.1, 294/22–24, 26, 27.1, 92; 29/270, 278, 283; 81/119, 176.1, 487, 488

[56] References Cited

U.S. PATENT DOCUMENTS

| | | | |
|---|---|---|---|
| 678,898 | 7/1901 | O'Carroll | 294/22 |
| 1,732,804 | 10/1929 | Chicoine et al. | 294/15 |
| 3,469,878 | 9/1969 | De Haan | 294/19.1 |
| 4,075,913 | 2/1978 | Tye | 294/19.1 x |
| 4,123,882 | 11/1978 | Case et al. | 294/15 X |
| 4,573,378 | 3/1986 | McDonald | 294/19.1 X |
| 4,586,741 | 5/1986 | Muti | 294/19.1 |
| 4,802,391 | 2/1989 | Willhoite et al. | 294/19.1 X |
| 5,390,970 | 2/1995 | Gray | 294/19.1 |

FOREIGN PATENT DOCUMENTS

| | | | |
|---|---|---|---|
| 853340 | 10/1952 | Germany | 294/19.1 |

*Primary Examiner*—Johnny D. Cherry
*Attorney, Agent, or Firm*—Griffin, Butler, Whisenhunt & Kurtossy

[57] ABSTRACT

A cargo container swivel-stacking-pin tool (10) for insertion and removal of swivel stacking pins (11, 60) in cargo containers (13) includes a rigid elongated handle (12), a U-shaped pin-engaging member (14, 76) attached to the elongated handle and two trigger actuators (16, 18 and 90, 92) attached to the pin-engaging member. The pin-engaging member has a base member (26, 80) and first and second fork members (22,24 and 86, 88) attached to the base member which define a slot (28, 78) of a size for receiving a bottom insert section (30, 72) of a swivel stacking pin. The trigger actuators are attached to opposite sides of the base member for manipulating locking-head triggers of the swivel stacking pins for enabling top locking heads of the swivel stacking pins to rotate about rotation axes (55, 94) when the top insert sections thereof are inserted in engagement holes (13*a*) of the cargo containers. The first trigger actuator is closer to the first fork member and the second trigger actuator is closer to the second fork member. The elongated handle is attached to the pin engaging member in different manners for different purposes.

17 Claims, 2 Drawing Sheets

CARGO CONTAINER SWIVEL-STACKING-PIN TOOL

BACKGROUND OF THE INVENTION

This invention relates to cargo container handling in general, and specifically to a tool to assist a longshoreman in inserting and removing self-locking swivel stacking pins employed in the loading and stacking of containerized cargo on board ships and loading docks.

The use of container ships to transport containerized cargo has become one of the primary means for shipping. Standard size containers and pier-side crane systems substantially increase productivity while reducing manpower required, and hazards incurred, in loading and unloading freight transporting ships. Cargo containers are provided with metal reinforcing corners, or plates, at top and bottom surfaces thereof. These metal reinforced corners provide attachments for turnbuckle attached tie-down cables and are provided with openings through flat steel plates therein to receive latches on spreader mechanisms of cranes for lifting and positioning the containers on board ships or on pier-side docks. In the prior art, after a first container had been positioned by a crane operator, a longshoreman "latcher" released the spreader mechanism from the first, or bottom, container and a second longshoreman "stacking pin installer" normally placed individual stacking pins in the plates of each of the first container's exposed upper reinforced corners to permit stacking of a second container onto the first container. After the second container had been stacked thereon, a lever of each of the stacking pins had to be rotated to lock the first and second containers together. Similarly, when the second container was removed from the first container, the stacking pin levers had to be rotated to unlock the containers.

Such stacking pins served to support the entire weight of the second "stacked" container in spaced relationship over the first container with a space therebetween permitting passage of tie-down cables. These stacking pins have varied in structural shape and from ship-to-ship, and have, in the past, normally been 6–10 inches in length and weighed up to 20 pounds or more, each.

U.S. Pat. No. 5,390,970 to William H. Gray discloses a shipping container stacking pin tool for inserting such stacking pins without the use of ladders in first containers. In this regard, prior to the Gray invention, the stacking pins were placed in first containers by hand using ladders.

Although the Gray invention simplifies placement of stacking pins for first containers, it does very little for such pin placement for second, third and fourth containers in a stack. Thus, it has still often been necessary for workers to "ride the spreader bar" on cranes to install and remove pins, which has been somewhat dangerous and time consuming.

Now, a new type of stacking pin, a self-locking swivel stacking pin, has been developed which can be inserted at the bottom of a container. That is, a first, or bottom, container is put in place without stacking pins at bottom or top corners thereof. Each of the self-locking, or automatic, swivel stacking pins has a pin housing with a spacer section and top and bottom insert sections on opposite sides of the spacer section, top and bottom locking heads respectively adjacent the top and bottom insert sections, and an axle attached to at least one of the top and bottom swivel locking heads for allowing rotation thereof. The top and bottom insert sections are rectangular in shape so that they match rectangular holes in the corner plates of the containers. The top and bottom insert sections and the top and bottom locking heads are elongated in a direction perpendicular to an axis of the rotatable axle.

To use these self-locking swivel stacking pins, an operator can insert the top locking head and top insert section into a hole of the plate at the lower edge of the second container. The operator then causes the locking head to rotate so that it is no longer aligned with the elongated hole, to thereby latch, or lock, the self-locking swivel stacking pin on the lower edge of the second container. After four such pins are placed at the second container's lower edge, the second container is lifted above the first container and the stacking pins, which are mounted on the second container, are aligned with the rectangular holes at top corners of the first container. The second container is then lowered so that the bottom swivel locking heads of the swivel stacking pins engage edges defining the holes in the first container's top corner plates and these bottom swivel locking heads, due to their shape, automatically rotate to align with their respective bottom insert sections. In doing this, they do not cause the top locking heads to align with the top insert sections. Once the lower locking heads pass through the first container's holes, they rotate to be locked to the first container. Thus, both top and bottom locking heads are locked to their respective second and first containers. This automatic locking procedure can also be used for stacking the third, fourth and fifth containers without the necessity of a worker "riding the spreader bar" on the crane.

From this position, for unlocking, hand-operated mechanisms on the swivel stacking pins must be reached for rotating the locking heads and thereby unlocking the swivel stacking pins from the containers, when this is desirable.

Although these new self-locking swivel stacking pins have many benefits over earlier stacking pins for container stacks higher than two containers, they have the detriment that when a "stacking pin installer" is installing one of them he is standing directly under a lifted (second, third, etc.) container, which is extremely dangerous. Further, when a self-locking swivel stacking pin is not mounted on a container, it is difficult to operate its hand-operated mechanism for rotating its locking heads. Still further, the self-locking swivel locking pins are quite awkward in shape and extremely heavy (up to 20 pounds or more) and therefore difficult for an operator to grip, actuate, and install.

A self-locking swivel-stacking-pin tool for use in handling a special swivel stacking pin is disclosed in patent application Ser. No. 08/513,639, filed Aug. 10, 1995, now U.S. Pat. No. 5,516,171. Although the swivel-stacking-pin tool described in that application has many benefits, it cannot be used for handling many popular cargo container swivel stacking pins.

Because of the above problem, it is an object of this invention to provide a cargo container swivel-stacking-pin tool which can be used for handling popular swivel stacking pins of a type including a locking-head trigger.

It is a further object of this invention to provide a cargo container swivel-stacking-pin tool which can be used for engaging swivel stacking pins, of a type having a locking-head trigger, and inserting or removing such swivel stacking pins from cargo containers.

Similarly, it is an object of this invention to provide such a swivel-stacking-pin tool which, while it is engaging a swivel stacking pin, can be manipulated to manipulate the locking-head trigger of the swivel stacking pin for bringing about rotation of at least the top locking head when the top insert section is inserted in a plate of a cargo container and the top locking head is locked thereto.

Also, it is an object of this invention to provide such a cargo container swivel-stacking-pin tool which is easy to manipulate, inexpensive to manufacture, and has no relatively moving parts.

SUMMARY OF THE INVENTION

According to principles of this invention, a cargo container swivel-stacking-pin tool includes a rigid elongated handle, a pin-engaging member attached to the elongated handle and at least one trigger actuator attached to the pin-engaging member. The pin-engaging member is usually a U-shaped frame so that a base member and first and second fork members attached to the base member define a slot of a size for receiving a bottom insert section of a swivel stacking pin. In one embodiment first and second trigger actuators are attached to opposite sides of the base member for manipulating locking-head triggers of swivel stacking pins for enabling top locking heads of the swivel stacking pins to rotate about rotation axes for unlocking them from plates of cargo containers. The first trigger actuator is closer to the first fork member and the second trigger actuator is closer to the second fork member. The trigger actuators and pin-engaging member have different shapes depending upon configurations of swivel stacking pins. Similarly, the elongated handle is attached to the pin engaging member in different manners for different purposes.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
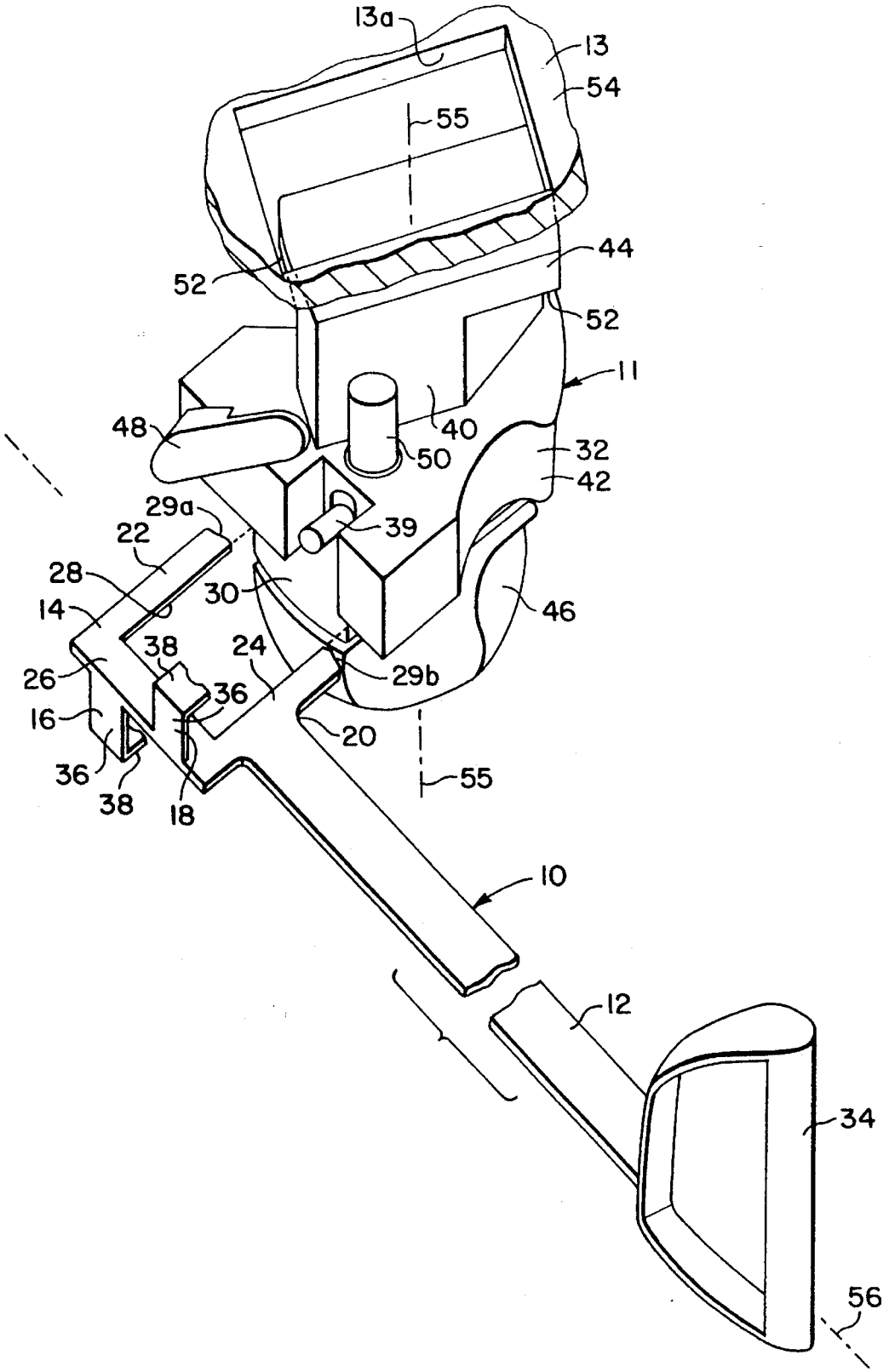
FIG. 1 is an exploded, isometric, partially cutaway view of a cargo container swivel-stacking-pin tool of this invention, a first-type self-locking swivel stacking pin (with a locking-head trigger) and a corner plate of a container.

The first embodiment swivel-stacking-pin tool 10 for manipulating a self-locking swivel stacking pin 11 into a container plate hole 13*a* of a container 13 comprises a rigid elongated handle 12, a rigid pin-engaging member 14 and first and second trigger actuators 16 and 18. The swivel-stacking-pin tool 10 is formed of steel, with the various parts thereof being welded to one another so that the entire swivel-stacking-pin tool is a single monolithic element.

The pin-engaging member 14 is formed substantially as a flat U-shaped frame with opposite first and second fork members 22 and 24 on first and second sides thereof, a base member 26 to which the first and second fork members are attached at a third side, and an opening at a fourth side thereof, opposite the base member 26, so that the first and second fork members 22 and 24 and the base member 26 define a slot 28. The slot 28 is open at free ends 29*a* and 29*b* of the first and second fork members 22 and 24 for receiving a bottom insert section 30 of a housing 32 of the swivel stacking pin 11.

The elongated handle 12 includes at an outer end thereof an elongated grip 34 which extends perpendicular to the axis of elongation of the elongated handle 12.

The first and second trigger actuators 16 and 18 are basically L-shaped brackets attached on opposite sides of the base member 26, each having a base leg 36 attached to the base member 26, and extending perpendicular away therefrom, and a free leg 38 with an outer free end thereof extending in the same direction as outer free ends 29*a* and *b* of the first and second fork members 22 and 24.

The trigger actuators 16 and 18 are positioned such that their free legs 38 will engage a locking-head trigger 39 of the swivel stacking pin 11 when the pin-engaging member 14 receives the bottom insert section 30 of the swivel stacking pin 11.

Looking now in more detail at the swivel stacking pin 11, a housing 32 thereof comprises a top insert section 40 and a bottom insert section 30. A spacer section 42 is positioned between the top and bottom insert sections 40 and 30 to space containers into which the top and bottom insert sections 40 and 30 are inserted. The top and bottom insert sections 40 and 30 and the spacer section 42 form the rigid housing 32. The swivel stacking pin 11 further comprises top and bottom locking heads 44 and 46 respectively on opposite sides of the housing 32 adjacent the respective top and bottom insert sections 40 and 30. The top locking head 44 is formed as one rigid piece with the top insert section 40. The bottom locking head 46 is attached to one end of a rotatable axis (not shown) which is mounted for rotation in the housing 32. The rotatable axis and the bottom locking head 46 can be rotated by a pivotal lever 48.

The container hole 13*a* is larger than the top locking head 44 and the top insert section 40. However, it can be seen that the top insert section 40 is irregularly shaped such that the top locking head 44 extends as a flange out beyond corners of the top insert section 40.

Describing operation of the swivel-stacking-pin tool of FIG. 1, an operator grips the handle 12 with one hand at the handgrip 34 and with his other hand (when necessary) along the length thereof. The operator manipulates the elongated handle so as to move the pin engaging member 14 onto the bottom insert section 30 of the swivel stacking pin 11. When the bottom insert section 30 is in the slot 28, in the orientation depicted in FIG. 1, the free leg 38 of the second trigger actuator 18 engages the top of the trigger 39. The operator can use the swivel-stacking-pin tool 10 to engage a swivel stacking pin 11 in this manner when the swivel stacking pin 11 is on a dock or mounted on a second (or greater) cargo container.

Assuming the operator is using the swivel-stacking-pin tool 10 to mount the swivel stacking pin 11 in the container hole 13*a* of the container 13, he lift the swivel stacking pin 11 from the dock and shoves the top locking head 44 and the top insert section 40 through the container hole 13*a*. When the operator does this, a top of a latch 50, which is attached to the trigger 39 impinges on a bottom surface of the container plate 13 and, as the operator shoves the swivel stacking pin upwardly, is pushed downwardly to also move the trigger 39 downwardly. Eventually, bottom surfaces 52 of the top locking head 44 clear a top surface 54 of the container plate 13. At this point, the operator, using the swivel-stacking-pin tool 10, rotates the housing 32 and the attached top insert section 40 as well as the top locking head 44. The top locking head 44 thusly moves above the top surface 54 of the container plate 13 and the latch 50 moves into the opening 13*a*. When the latch 50 moves into the opening 13*a*, a biasing spring, which is attached to the latch 50 and the trigger 39, forces the latch 50 upwardly also through the container hole 13*a*. The latch 50 thereby prevents the housing 32 from being rotated back so that bottom surfaces 52 of the top locking head 44 prevent the swivel stacking pin 11 from being pulled out of the container hole 13*a*. The operator then pulls the swivel-stacking-pin tool 10, which is now mounted on the container 13, from the swivel stacking pin 11.

In order to remove the swivel stacking pin 11 from the container plate 13, the swivel stacking pin 11 is manipulated to place the bottom insert section in the slot 28 in the manner mentioned above. The swivel-stacking-pin tool is then rotated in a counterclockwise direction (as seen from the grip 34 end) about its axis of elongation 56 so that the free leg 38 of the second trigger actuator 18 impinges on the trigger 39 and presses it downwardly, thereby also pressing the latch 50 downwardly. The first and second fork members 22 and 24 act as levers during this manipulation, with outer free ends 29*a* and *b* thereof forming fulcrums against a bottom surface of the spacer section 42. Eventually, the latch 50 clears the container plate 13 so that the housing 32 of the swivel stacking pin 11 can be rotated about a rotation axis 55 of the swivel stacking pin 11. The housing 32 is then rotated by the swivel-stacking-pin tool 11 so that the top insert section 40 and the top locking head 44, which is rigidly attached to the housing, are also rotated. Eventually, the top locking head 44 aligns with the container hole 13*a* and the swivel stacking pin 11 is pulled from the container hole 13*a* using the swivel-stacking-pin tool 11.

Figure 2:
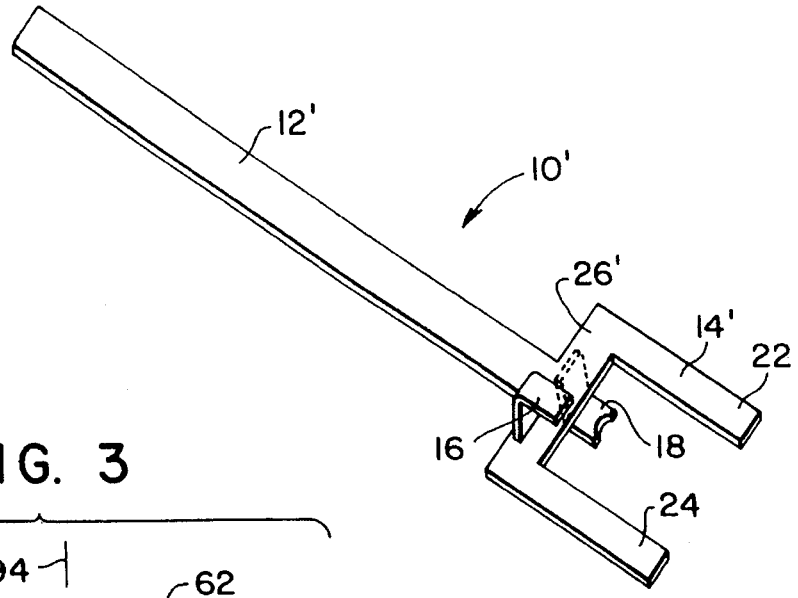
FIG. 2 is an isometric view of a second embodiment of the cargo container swivel-stacking-pin tool of FIG. 1.

FIG. 2 depicts a second embodiment of the swivel-stacking-pin tool 10' which is substantially the same as the swivel-stacking-pin tool 10 of FIG. 1 but that an elongated handle 12' is attached to a base member 26' of a pin-engaging member 14' to extend parallel to first and second fork members 22 and 24. In this embodiment, it is not necessary to have a special grip, such as the grip 34, which is perpendicular to the axis of elongation of the handle 12 because the elongated handle 12' itself can be used for pivoting the pin-engaging member 14', as is necessary for causing the trigger actuators 16 and 18 to act on the trigger 39. In fact, the swivel-stacking-pin tool 10' of FIG. 2 is used in situations where it is difficult to move the trigger 39 because an operator can apply greater leverage with the elongated handle 12' of FIG. 2 than he can using the grip 34 of FIG. 1.

A particular benefit of the arrangement of FIG. 1 is that an operator can use it with the handle 12 extending to either side of the swivel stacking pin 11. That is, looking at FIG. 1, the swivel-stacking-pin tool 10 could be turned over with the grip 34 directed upwardly to the left, rather than downwardly to the right as shown in FIG. 1. In that case, the first trigger actuator 16, rather than the second trigger 18, would operate the trigger 39.

Figure 3:
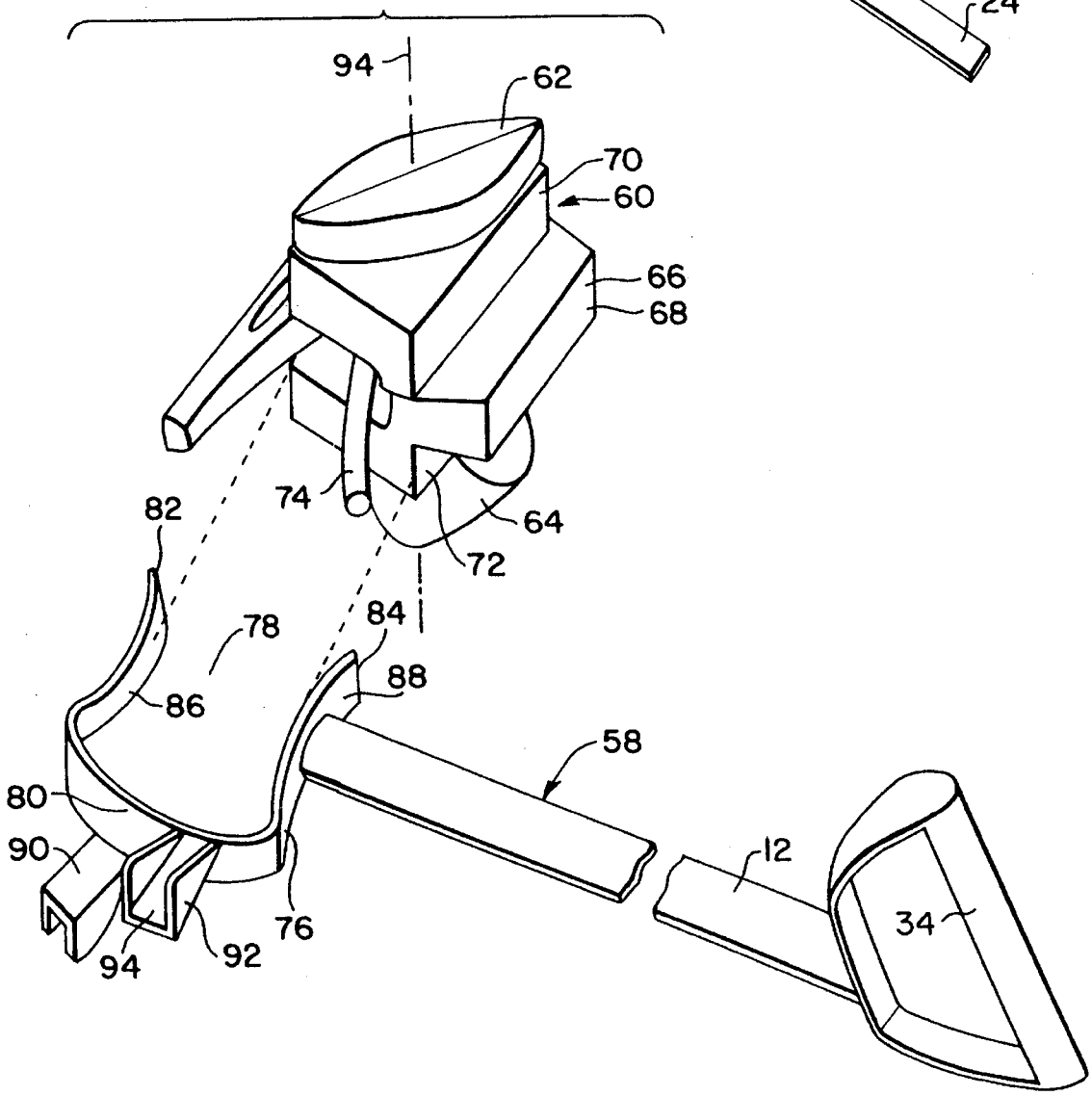
FIG. 3 is an exploded view of a third embodiment of the cargo container swivel-stacking-pin tool of this invention with a second-type self-locking swivel stacking pin having a locking-head trigger thereon.

FIG. 3 shows a third embodiment of the swivel-stacking-pin tool 10 which is to be employed with a second type of swivel stacking pin 60. The swivel stacking pin 60 differs from the swivel stacking pin 11 in that top and bottom locking heads 62 and 64 thereof are interconnected by a biased shaft (not shown) so as to be rotatable relative to a housing 66 comprising a spacer section 68 and top and bottom insert sections 70 and 72. The shaft which interconnects the top and bottom locking head 62 and 64 is also attached to a trigger lever 74 which can be used for rotating the top and bottom locking head 62 and 64. The top insert section 70 is substantially the same size and shape as container holes 13*a*.

Looking now in more detail at the swivel-stacking-pin tool 58 of FIG. 3, the handle 12 and grip 34 are substantially the same as those of the FIG. 1 embodiment. However, a pin-engaging member 76 thereof has a different shape than the pin-engaging member 14 of FIG. 1. In this regard, a slot 78 formed by the pin-engaging member 76 is quite a bit wider (distance between first and second fork members 86 and 88) near a base member 80 than it is closer to free ends 82 and 84 of the first and second fork members 86 and 88. The pin-engaging member 76 is formed of a band of steel which is bent into this configuration. First and second trigger actuators 90 and 92 have trough-shapes for receiving the trigger lever 74.

When using the swivel-stacking-pin tool 68 of FIG. 3, the pin-engaging member 76 is manipulated by the handle 12 so that the slot 78 will receive the bottom insert section 72 of the swivel stacking pin 60. When the bottom insert section 72 is fully seated in the slot 78 in the orientation shown in FIG. 3, the trigger lever 74 will be in a trough 94 of the second trigger actuator 92. The operator can then rotate the pin-engaging member 76 about an axis 94 of the swivel stacking pin 60 so that the second trigger actuator 92 causes the trigger lever 74 to rotate the axle (not shown), and thereby to rotate the top and bottom locking heads 62 and 64. In this manner, the swivel-stacking-pin tool 58 can be used for latching and unlatching the swivel stacking pin 60 to and from a container plate.

It will be appreciated by those of ordinary skill in the art that the unusual shape of the slot 78 allows the first and second fork members 86 and 88 to relatively tightly grip the sides of the bottom insert section 72 of the swivel stacking pin 60 while yet allowing it to be rotated about the axis 94 of the axle of the swivel stacking pin 60 relative to the swivel stacking pin 60. In this manner, the swivel-stacking-pin tool 68 can be used not only for gripping the swivel stacking pin 60 and manipulating it, but also for moving its top and bottom locking heads 62 and 64 relative to the housing 66 for locking and unlocking the swivel stacking pin 60 to and from cargo containers.

It can be seen in FIG. 3 that the first and second trigger actuators 90 and 92 are respectively positioned on the base member 80 closer to the respective first and second fork members 86 and 88. Thus, the swivel-stacking-pin tool 58 can extend in either direction from the swivel stacking pin 60. That is, the swivel-stacking-pin tool 58 could be turned upside down with the grip 34 being directed upwardly to the left rather than downwardly to the right as is shown in FIG. 3. In that case, the first trigger actuator 90 would then engage the trigger lever 74.

It will be appreciated by those of ordinary skill in the art that the various embodiments of the swivel-stacking-pin tool of this invention allow a longshoreman to easily and safely manipulate swivel stacking pins to bring them into position for being inserted into and removed from cargo containers. At the same time, the swivel-stacking-pin tool of this invention allows longshoreman operators to unlatch swivel stacking pins from cargo containers. It is particularly significant that the swivel-stacking-pin tool of this invention does all this without having any movable parts.

It is also extremely beneficial that the elongated-handle, swivel-stacking-pin tool of this invention can extend in either of two opposite directions from a swivel stacking pin when it is used to manipulate the swivel stacking pin. In this regard, the swivel-stacking-pin tool can be used to operate on swivel stacking pins located at opposite corners of cargo containers, with the operators positioning themselves away from edges of the containers, as is desirable. If it were only possible for the elongated handle to extend in one direction, it would be necessary for operators to sometime be unduly close to or under edges of the containers.

The embodiment of FIG. 2, in which the elongated handle extends parallel to the first and second fork members, is particularly beneficial because, with this embodiment, more leverage can be placed on trigger actuators for unlatching particularly difficult-to-operate triggers.

While the invention has been particularly shown and described with reference to a preferred embodiment, it will be understood by those of ordinary skill in the art that various changes in form and detail may be made therein without departing from the spirit and scope of the invention. For example, if the trigger 39 of a swivel stacking pin 11 were centered on the swivel stacking pin, the trigger actuators of the swivel-stacking-pin tool of this invention could be place immediately opposite one another on the pin-engaging member.

It will be appreciated that the swivel-stacking-pin tool of this invention will have to be configured differently to handle swivel stacking pins with triggers, or trigger levers, of different configurations.

The invention claimed is:

1. A swivel-stacking-pin tool for insertion and removal of swivel stacking pins into and from cargo containers, said swivel stacking pins being employed to provide spacing support for stacking said cargo containers and being of a type comprising a pin housing with a spacer section and top and bottom insert sections on opposite sides of the spacer section, top and bottom locking heads respectively on opposite sides of the housing adjacent the respective top and bottom insert sections, and a movable locking-head trigger for being manipulated to enable at least said top locking head to rotate about a rotation axis passing through said top and bottom locking heads when said top insert section is inserted in an engagement hole in a cargo container, said swivel locking pin tool comprising:

an rigid elongated handle;

a pin-engaging member attached to a pin end of said elongated handle, said pin-engaging member forming substantially a U-shaped frame with opposite first and second fork members on first and second sides, a base member attached to said first and second fork members on a third side, with a fourth side thereof, opposite the base member, being open so that the first and second fork members define a slot for receiving the bottom insert section of the swivel stacking pin; and a trigger actuator rigidly attached to said pin-engaging member for engaging said locking-head triggers of said swivel stacking pins and for manipulating said locking-head triggers for enabling said top locking heads to rotate about said rotation axis when said top insert sections are inserted in said engagement holes in said cargo containers.

2. A swivel-stacking-pin tool as in claim 1 wherein there are two trigger actuators, each located on an opposite side of the pin-engaging member from the other.

3. A swivel-stacking-pin tool as in claim 2 wherein the two trigger actuators are mounted on the base member.

4. A swivel-stacking-pin tool as in claim 3 wherein the first trigger actuator is positioned closer to the first fork member than the second fork member and the second trigger actuator is positioned closer to the second fork member than to the first fork member.

5. A swivel-stacking-pin tool as in claim 4 wherein said elongated handle is attached to the first fork member and extends generally parallel to the base member.

6. A swivel-stacking-pin tool as in claim 4 wherein said elongated handle is attached to the base member and extends generally parallel to the first and second fork members.

7. A swivel-stacking-pin tool as in claim 4 wherein said trigger actuators are substantially L-shaped, with free ends thereof extending in a direction of free ends of the fork members.

8. A swivel-stacking-pin tool as in claim 4 wherein said trigger actuators are substantially trough-shaped, with free ends thereof extending in an opposite direction than the free ends of the fork members.

9. A swivel-stacking-pin tool as in claim 8 wherein the fork members are shaped such that the slot is wider closer to the base member than it is further away from the base member so that the pin-engaging member can be snug on bottom insert sections of swivel stacking pins but yet the pin-engaging member can be rotated on the bottom insert sections about the rotation axis.

10. A swivel-stacking-pin tool as in claim 4 wherein the fork members are shaped such that the slot is wider closer to the base member than it is further away from the base member so that the pin-engaging member can be snug on bottom insert sections of swivel stacking pins but yet the pin-engaging member can be rotated on the bottom insert sections about the rotation axis.

11. A swivel-stacking-pin tool as in claim 1 wherein said elongated handle is attached to the first fork member and extends generally parallel to the base member.

12. A swivel-stacking-pin tool as in claim 1 wherein said elongated handle is attached to the base member and extends generally parallel to the first and second fork members.

13. A swivel-stacking-pin tool as in claim 1 wherein said trigger actuator is substantially L-shaped, with a free end thereof extending in a direction of free ends of the fork members.

14. A swivel-stacking-pin tool as in claim 1 wherein said trigger actuator is substantially trough-shaped, with a free end thereof extending in an opposite direction than the free end of the fork members.

15. A swivel-stacking-pin tool as in claim 1 wherein the fork members are shaped such that the slot is wider closer to the base member than it is further away from the base member so that the pin-engaging member can be snug on bottom insert sections of swivel stacking pins but yet the pin-engaging member can be rotated on the bottom insert sections about the rotation axis.

16. A swivel-stacking-pin tool as in claim 1 wherein said elongated handle includes a grip at a grip end thereof, opposite the pin end, which extends perpendicular to a main axis of elongation of the handle.

17. A swivel-stacking-pin tool as in claim 1 wherein the trigger actuator is attached to the base member.

* * * * *